US011184965B2

(12) United States Patent
Wen et al.

(10) Patent No.: US 11,184,965 B2
(45) Date of Patent: *Nov. 23, 2021

(54) LIGHT EMITTING DIODE DRIVING CIRCUIT

(71) Applicant: XIAMEN ECO LIGHTING CO. LTD., Xiamen (CN)

(72) Inventors: Shuisheng Wen, Xiamen (CN); Liping Lin, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 32 days.

This patent is subject to a terminal disclaimer.

(21) Appl. No.: 16/852,502

(22) Filed: Apr. 19, 2020

(65) Prior Publication Data

US 2020/0245431 A1 Jul. 30, 2020

Related U.S. Application Data

(63) Continuation-in-part of application No. 16/671,735, filed on Nov. 1, 2019.

(60) Provisional application No. 62/754,054, filed on Nov. 1, 2018.

(51) Int. Cl.

| | |
|---|---|
| ***H05B 45/325*** | (2020.01) |
| ***H05B 45/345*** | (2020.01) |
| ***H05B 47/105*** | (2020.01) |
| ***H05B 45/48*** | (2020.01) |
| ***H05B 33/08*** | (2020.01) |

(52) U.S. Cl.
CPC ..... *H05B 45/325* (2020.01); *H05B 33/08* (2013.01); *H05B 45/48* (2020.01)

(58) Field of Classification Search
CPC ..... H05B 45/10; H05B 45/20; H05B 45/48; H05B 45/325; H05B 33/08; H05B 47/19
See application file for complete search history.

(56) References Cited

U.S. PATENT DOCUMENTS

2007/0212103 A1* 9/2007 Kikuchi ..... G03G 15/0283 399/88

* cited by examiner

*Primary Examiner* — Henry Luong
(74) *Attorney, Agent, or Firm* — Chun-Ming Shih; Lanway IPR Services

(57) ABSTRACT

An LED driving circuit includes a power source, a first voltage stepping-down module, a constant current driving module, a second voltage stepping-down module, a DIP switch module, a control module and a loading module. The power source provides a source voltage. The first voltage stepping-down module reduces the source voltage's voltage level and correspondingly generates a first buck voltage. The second voltage stepping-down module reduces the first buck voltage's voltage level to generate a second buck voltage. The DIP switch module generates a maximal current indicating signal according to the second bulk voltage. The control module generates a PWM signal based on the second buck voltage and the maximal current indicating signal. The constant current driving module generates a drive current according to the first buck voltage and the PWM signal, and drives the loading module using the drive current.

20 Claims, 4 Drawing Sheets

LIGHT EMITTING DIODE DRIVING CIRCUIT

RELATED APPLICATION

The present application is a continuation-in-part application of U.S. patent application Ser. No. 16/671,735.

FIELD OF THE INVENTION

The present invention relates to a light emitting diode (LED) driving circuit, and more particularly, to a LED driving circuit capable of switching multiple types of currents for driving multiple types of LEDs.

BACKGROUND

Electroluminescence, an optical and electrical phenomenon, was discover in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

A conventional LED driving circuit, especially for that has at least one radio frequency (RF) module, has only one set of output current. And it significantly downgrades a user's experience. In addition, such conventional LED driving circuit cannot be adapted for various types of loading LED units because of its single type of output current.

SUMMARY OF THE INVENTION

The present disclosure aims at disclosing a LED driving circuit, which includes a power source, a first voltage stepping-down module, a constant current driving module, a second voltage stepping-down module, a dual-in-line package (DIP) switch module, a control module, and a loading module. The power source provides a source voltage. The first voltage stepping-down module is electrically coupled to the power source. And the first voltage stepping-down module reduces the source voltage's voltage level and correspondingly generates a first buck voltage. The constant current driving module is electrically coupled to the first voltage stepping-down module. The second voltage stepping-down module is electrically coupled to the first voltage stepping-down module. In addition, the second voltage stepping-down module reduces the first buck voltage's voltage level to generate a second buck voltage. The DIP switch module is electrically coupled to the second voltage stepping-down module. Moreover, the DIP switch module generates a maximal current indicating signal according to the second bulk voltage. The control module is electrically coupled to the second voltage stepping-down module, the DIP switch module and the constant current driving module. Additionally, the control module generates a pulse-width modulation (PWM) signal based on the second buck voltage and the maximal current indicating signal. The loading module is electrically coupled to the control module and the constant current driving module. Last, the constant current driving module generates a drive current according to the first buck voltage and the PWM signal. Also, the constant current driving module drives the loading module using the drive current.

In one example, the first voltage stepping-down module includes a voltage stepping-down chip. The voltage stepping-down chip's input terminal is electrically coupled to the power source. Also, the voltage stepping-down chip's output terminal is electrically coupled to the constant current driving module. Last, the voltage stepping-down chip's ground terminal is coupled to ground.

In one example, the constant current driving module includes a driving chip and a switch. The driving chip's input terminal is electrically coupled to the first voltage stepping-down module for receiving the first buck voltage. In addition, the driving chip's control terminal is electrically coupled to the control module for receiving the PWM signal. The switch's control terminal is electrically coupled to a drive terminal of the driving chip. Second, the switch's input terminal is electrically coupled to ground and an output terminal of the driving chip. Third, the switch's output terminal is electrically coupled to the loading module.

In one example, the constant current driving module further includes a resistor. The resistor's first terminal is electrically coupled to the input terminal of the switch and the output terminal of the driving chip. Also, the resistor's second terminal is electrically coupled to ground.

In one example, the switch includes a metal-oxide semiconductor field effect transistor (MOSFET). First, the switch's control terminal includes a gate of the MOSFET. Second, the switch's input terminal includes a drain of the MOSFET. Third, the switch's output terminal includes a source of the MOSFET.

In one example, the switch includes a bipolar junction transistor (BJT). First, the switch's control terminal includes a base of the BJT. Second, the switch's input terminal includes a collector of the BJT. Third, the switch's output terminal includes an emitter of the BJT.

In one example, the second voltage stepping-down module includes a voltage stepping-down chip. The voltage stepping-down chip's input terminal is electrically coupled to the first voltage stepping-down module for receiving the first buck voltage. Also, the voltage stepping-down module's output terminal is electrically coupled to the DIP switch module for relaying the second buck voltage. Moreover, the voltage stepping-down module's ground terminal is electrically coupled to ground.

In one example, the DIP switch module includes a first resistor, at least one DIP switch and at least one second resistor. The first resistor's first terminal is electrically coupled to the second voltage stepping-down module for receiving the second buck voltage. Each of the at least one DIP switch's input terminal is electrically coupled to a second terminal of the first resistor and the control module. The at least one second resistor has a one-by-one correspondence with the at least one DIP switch. Each of the at least one second resistor's first terminal is electrically coupled to an output terminal of a corresponding DIP switch. And each of the at least one second resistor's second terminal is electrically coupled to ground.

In one example, resistances of the at least one second resistor are entirely different.

In another example, resistances of the at least one second resistor are partially different.

In still another example, the at least one second resistor shares a same resistance.

In one example, the control module includes a master control chip. The master chip's input terminal is electrically coupled to the second voltage stepping-down module for receiving the second buck voltage. In addition, the master chip's receiving terminal is used for receiving the maximal current indicating signal. And the master chip's control terminal is electrically coupled to the constant current driving module for relaying the PWM signal. Last, the master chip's ground terminal is electrically coupled to ground.

In one example, the LED driving circuit further includes a voltage transformer. And the voltage transformer is electrically coupled to the first voltage stepping-down module, the constant current driving module, and the loading module.

In one example, the voltage transformer includes a primary winding and a secondary winding. The primary winding's first terminal is electrically coupled to the first voltage stepping-down module. Also, the primary winding's second terminal is electrically coupled to the constant current driving module. The secondary winding is electrically coupled to the loading module.

In one example, the source voltage is a direct-current (DC) voltage.

In one example, the DC voltage is generated by rectifying an alternative-current (AC) voltage.

In another example, the source voltage is an alternative-current (AC) voltage.

In one example, the loading module includes a LED unit.

In one example, the loading module also includes a diode and a common mode inductor. The diode's positive terminal is electrically coupled to the constant current driving module. The common mode inductor's first input terminal is electrically coupled to a negative terminal of the diode. Second, the common mode inductor's second input terminal is electrically coupled to ground. Third, the common mode inductor's first output terminal and second output terminal both electrically coupled to the LED unit.

In one example, the loading module additionally includes a capacitor. The capacitor's first terminal is electrically coupled to the first input terminal of the common mode inductor. And the capacitor's second terminal is electrically coupled to ground.

These and other objectives of the present invention will no doubt become obvious to those of ordinary skill in the art after reading the following detailed description of the preferred embodiment that is illustrated in the various figures and drawings.

DETAILED DESCRIPTION

As mentioned above, the present disclosure discloses a LED driving circuit capable of adjusting its output current. Such that the disclosed LED driving circuit can be used for driving various types of LED units of different current amplitudes.

Figure 1:
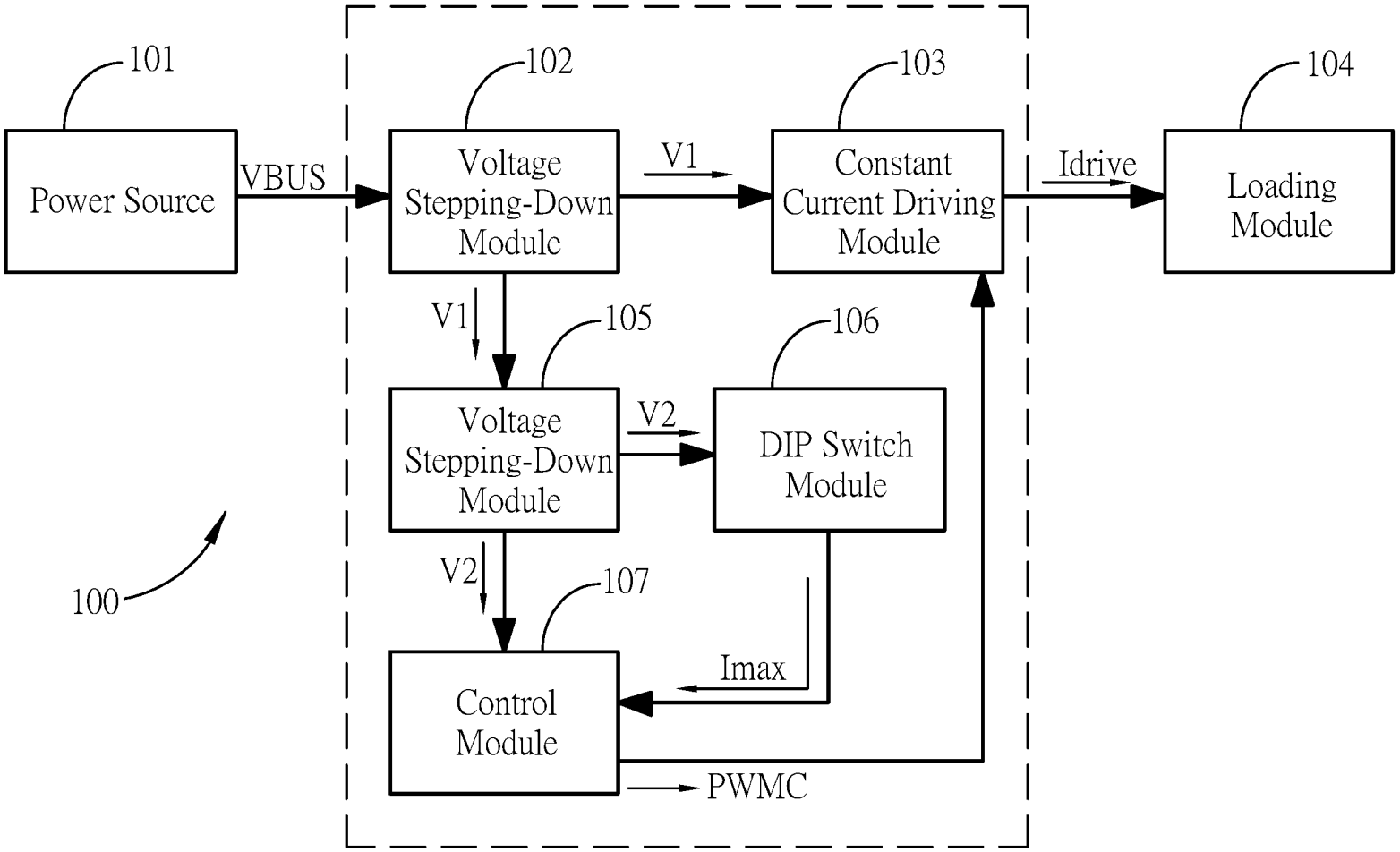
FIG. 1 illustrates a schematic diagram of a LED driving circuit according to one embodiment of the present invention.

FIG. 1 illustrates a schematic diagram of a LED driving circuit 100 according to one embodiment of the present invention. The LED driving circuit 100 includes a power source 101, a first voltage stepping-down module 102, a constant current driving module 103, a second voltage stepping-down module 105, a dual-in-line package (DIP) switch module 106, a control module 107, and a loading module 104.

The power source 101 provides a source voltage VBUS.

The first voltage stepping-down module 102 is electrically coupled to the power source 101. And the first voltage stepping-down module 102 reduces the source voltage VBUS's voltage level, so as to generate a first buck voltage V1.

The constant current driving module 103 is electrically coupled to the first voltage stepping-down module 102.

The second voltage stepping-down module 105 is electrically coupled to the first voltage stepping-down module 102. In addition, the second voltage stepping-down module 105 reduces the first buck voltage V1's voltage level, so as to generate a second buck voltage V2.

The DIP switch module 106 is electrically coupled to the second voltage stepping-down module 105. Moreover, the DIP switch module 106 generates a maximal current indicating signal Imax according to the second bulk voltage V2.

The control module 107 is electrically coupled to the second voltage stepping-down module 105, the DIP switch module 106 and the constant current driving module 103. Additionally, the control module 107 generates a pulse-width modulation (PWM) signal PWMC based on the second buck voltage V2 and the maximal current indicating signal Imax.

The loading module 104 is electrically coupled to the control module 107 and the constant current driving module 103. Last, the constant current driving module 103 generates a drive current Idrive according to the first buck voltage V1 and the PWM signal PWMC. Also, the constant current driving module 103 drives the loading module 104 using the drive current Idrive.

Specifically, in some examples, the DIP module 106 determines the maximal current indicating signal Imax for determining an upper-bound drive current of the LED driving circuit 100. Then, the control module 107 may determine an intermediate current amplitude that is smaller than the upper-bound drive current. In turn, the control module 107 generates the PWM signal for prompting the constant current driving module 103 to apply the intermediate current amplitude in the drive current Idrive. Therefore, the LED driving circuit 100 is capable of driving the loading module 104 via various amplitudes of drive currents. Such that the loading module 104 may also include various types of LED units. Furthermore, in some examples, the control module 107 determines the intermediate current amplitude by receiving a remote command, under the condition that the control module 107 has an additional RF module for receiving said remote command.

In some examples, the source voltage VBUS may be a direct-current (DC) voltage or an alternative-current (AC) voltage. The DC voltage can even be generated by rectifying an AC voltage.

Figure 2:
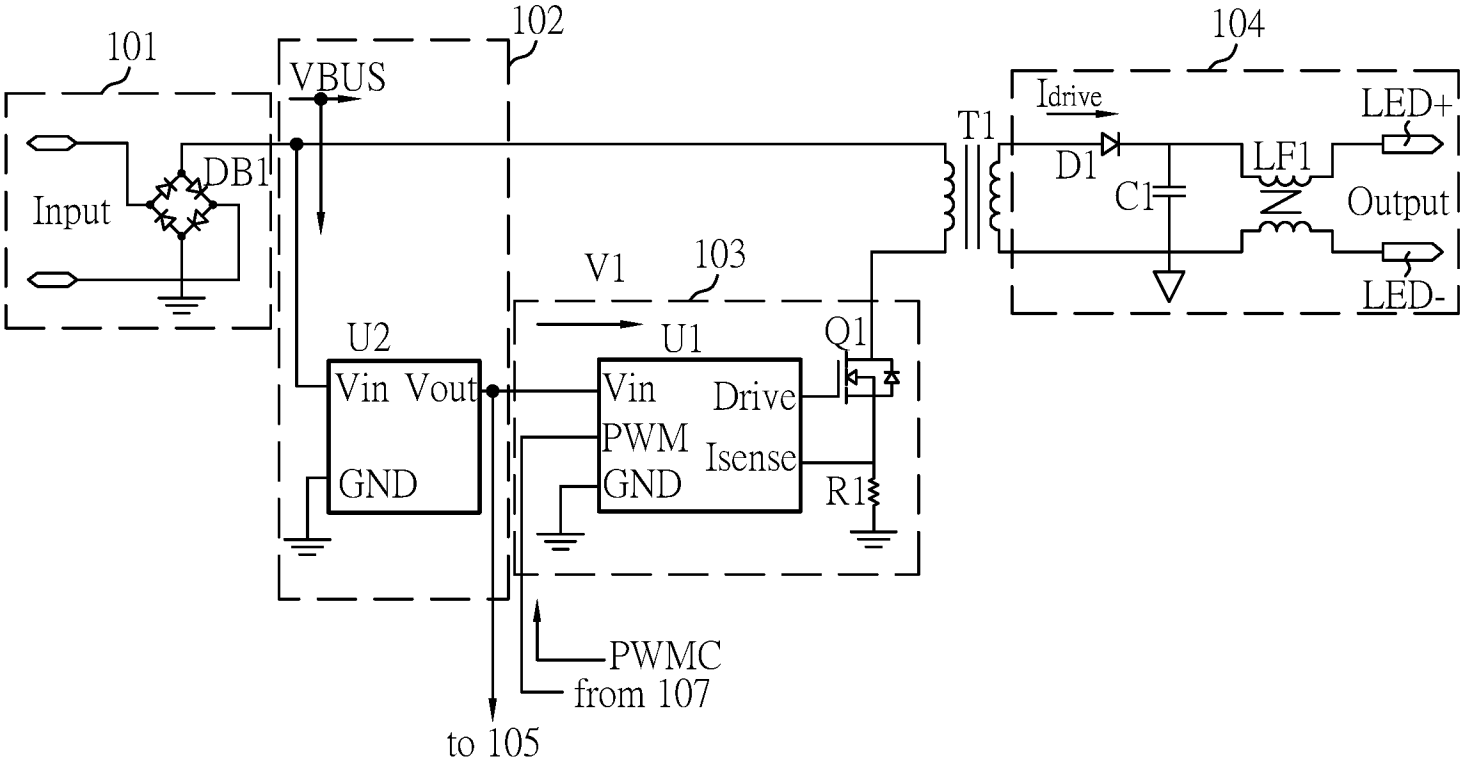
FIG. 2 illustrates a detailed circuit diagram of part of the LED driving circuit shown in FIG. 1.

FIG. 2 illustrates a detailed circuit diagram of part of the LED driving circuit 100 shown in FIG. 1.

In one example, the LED driving circuit 100 further includes a voltage transformer T1. And the voltage transformer T1 is electrically coupled to the first voltage stepping-down module 102, the constant current driving module 103, and the loading module 104.

In one example, the voltage transformer T1 includes a primary winding and a secondary winding. The primary winding's first terminal is electrically coupled to the first voltage stepping-down module 102. Also, the primary winding's second terminal is electrically coupled to the constant current driving module 103. The secondary winding is electrically coupled to the loading module 104.

In one example, the first voltage stepping-down module 102 includes a voltage stepping-down chip U2. The voltage stepping-down chip 102's input terminal Vin is electrically coupled to the power source 101. Also, the voltage stepping-down chip 102's output terminal Vout is electrically coupled to the constant current driving module 103. Last, the voltage stepping-down chip 103's ground terminal GND is coupled to ground.

In one example, the constant current driving module 103 includes a driving chip U1 and a switch Q1. The driving chip U1's input terminal Vin is electrically coupled to the first voltage stepping-down module 102 for receiving the first buck voltage V1. In addition, the driving chip U1's control terminal PWM is electrically coupled to the control module 107 for receiving the PWM signal PWMC.

The switch Q1's control terminal is electrically coupled to a drive terminal Drive of the driving chip U1. Second, the switch Q1's input terminal is electrically coupled to ground and an output terminal Isense of the driving chip U1. Third, the switch Q1's output terminal is electrically coupled to the loading module 104.

In one example, the constant current driving module 103 further includes a resistor R1. The resistor R1's first terminal is electrically coupled to the input terminal of the switch Q1 and the output terminal Isense of the driving chip U1. Also, the resistor R1's second terminal is electrically coupled to ground.

In one example, the switch Q1 is implemented using a metal-oxide semiconductor field effect transistor (MOSFET). Therefore, first, the switch Q1's control terminal is the gate of the MOSFET. Second, the switch Q1's input terminal is the drain of the MOSFET. Third, the switch Q1's output terminal is the source of the MOSFET.

In another example, the switch Q1 is implemented using a bipolar junction transistor (BJT). Therefore, first, the switch Q1's control terminal is the base of the BJT. Second, the switch Q1's input terminal is the collector of the BJT. Third, the switch Q1's output terminal is the emitter of the BJT.

Figure 3:
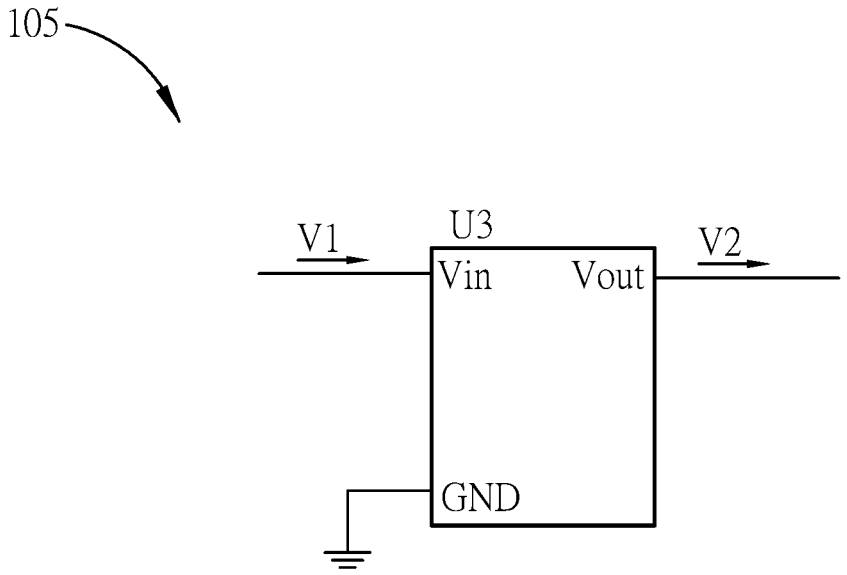
FIG. 3 illustrates an exemplary detailed diagram of the second voltage stepping-down module shown in FIG. 1.

FIG. 3 illustrates an exemplary detailed diagram of the second voltage stepping-down module 105 shown in FIG. 1. In one example, the second voltage stepping-down module 105 includes a voltage stepping-down chip U3. The voltage stepping-down chip U3's input terminal Vin is electrically coupled to the first voltage stepping-down module 102 for receiving the first buck voltage V1. Also, the voltage stepping-down chip U3's output terminal Vout is electrically coupled to the DIP switch module 106 for relaying the second buck voltage V2. Moreover, the voltage stepping-down chip U3's ground terminal is electrically coupled to ground.

Figure 4:
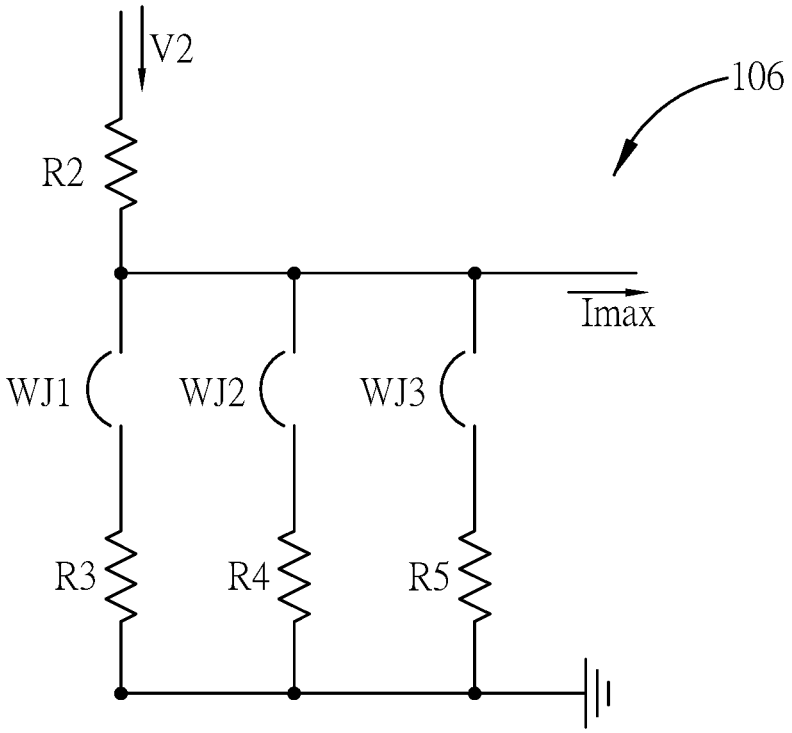
FIG. 4 illustrates an exemplary detailed diagram of the DIP switch module shown in FIG. 1.

FIG. 4 illustrates an exemplary detailed diagram of the DIP switch module 106 shown in FIG. 1. In one example, the DIP switch module 106 includes a first resistor R2, at least one DIP switch and at least one second resistor. For example, there are three DIP switches WJ1, WJ2 and WJ3 and three corresponding resistors R3, R4 and R5.

The first resistor R2's first terminal is electrically coupled to the second voltage stepping-down module 105 for receiving the second buck voltage V2. Each of the at least one DIP switch WJ1, WJ2 and WJ3's input terminal is electrically coupled to a second terminal of the first resistor R2 and the control module 107. The at least one second resistor R3, R4 and R5 has a one-by-one correspondence with the at least one DIP switch WJ1, WJ2 and WJ3. Each of the at least one second resistor R3, R4 and R5's first terminal is electrically coupled to an output terminal of a corresponding DIP switch WJ1, WJ2 and WJ3. And each of the at least one second resistor R3, R4 and R5's second terminal is electrically coupled to ground.

In some examples, resistances of the at least one second resistor R3, R4 and R5 are entirely different, partially different, or all the same. Such that the DIP switch module 106 is capable of controlling the upper-bound current indicating signal Imax's corresponding upper-bound current amplitude by switching on appropriate DIP switch(es) and correspondingly retrieve a desired total resistance and in turn a desired upper-bound current amplitude.

Figure 5:
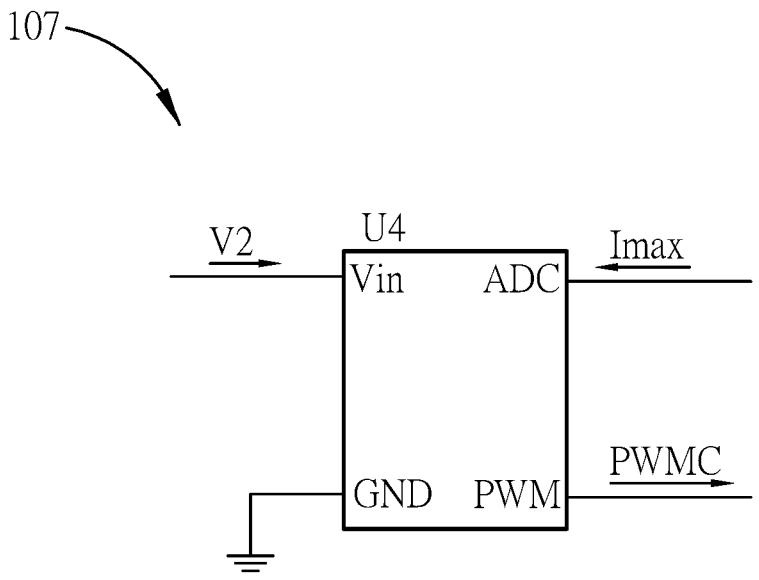
FIG. 5 illustrates an exemplary detailed diagram of the control module shown in FIG. 1.

FIG. 5 illustrates an exemplary detailed diagram of the control module 107 shown in FIG. 1. In one example, the control module 107 includes a master control chip U4. The master chip U4's input terminal Vin is electrically coupled to the second voltage stepping-down module 105 for receiving the second buck voltage V2. In addition, the master chip U4's receiving terminal ADC is used for receiving the maximal current indicating signal Imax. And the master chip U4's control terminal PWM is electrically coupled to the constant current driving module 103 for relaying the PWM signal PWMC. Last, the master chip U4's ground terminal GND is electrically coupled to ground.

As shown in FIG. 2, and in some examples, the loading module 104 may include a LED unit that has a positive terminal LED+ and a negative terminal LED−.

Also, in one example, the loading module 104 includes a diode D1 and a common mode inductor LF1. The diode D1's positive terminal is electrically coupled to the constant current driving module 103 for receiving the driving current Idrive.

The common mode inductor LF1's first input terminal is electrically coupled to a negative terminal of the diode D1. Second, the common mode inductor LF1's second input terminal is electrically coupled to ground. Third, the common mode inductor LF1's first output terminal and second output terminal both electrically coupled to the LED unit via the positive terminal LED+ and the negative terminal LED− respectively.

In one example, the loading module 104 additionally includes a capacitor C1. The capacitor C1's first terminal is electrically coupled to the first input terminal of the common mode inductor LF1. And the capacitor C1's second terminal is electrically coupled to ground.

How the LED driving unit 100 works is summarized in the following paragraphs by referencing FIGS. 1-5. First, the first voltage-stepping down module 102 bucks the source voltage VBUS to generate the first buck voltage V1. Then the constant current driving module 103 initially uses the first buck voltage V1 to drive the loading module 104. Simultaneously, the second voltage stepping-down module 105 bucks the first buck voltage V1 to generate the second buck voltage V2. And both the control module 107 and the DIP switch module 106 are stably powered via the second buck voltage V2.

The DIP switch module 106 determines an upper-bound output current amplitude for the drive current Idrive, with the aid of different configurations of the DIP switch module 106, e.g., different number of activated DIP switches and/or different resistances of applied resistors.

The control module 107 receives the maximal current indicating signal Imax. Also, with the aid of the control module 107's microprocessor, the control module 107 performs a modulus transformation on the maximal current indicating signal Imax. Such that the control module 107 perceives the upper-bound of the LED driving circuit 100's drive current. In some examples, the control module 107 also receives an external RF signal for calculating a desired output current amplitude based on the perceived upper-bound drive current via its microprocessor. In addition, the control module 107's microprocessor calculates the PWM signal PWMC for prompting the constant current driving module 103 to output the desired output current amplitude, i.e., the drive current Idrive.

In this fashion, the LED driving circuit 100 is capable of adapting to different types of LED units using drive currents of different corresponding amplitudes.

Those skilled in the art will readily observe that numerous modifications and alterations of the device and method may be made while retaining the teachings of the invention. Accordingly, the above disclosure should be construed as limited only by the metes and bounds of the appended claims.

The invention claimed is:

1. A light emitting diode (LED) driving circuit, comprising:

a power source, configured to provide a source voltage;

a first voltage stepping-down module, electrically coupled to the power source, and configured to reduce the source voltage and correspondingly generate a first buck voltage;

a constant current driving module, electrically coupled to the first voltage stepping-down module;

a second voltage stepping-down module, electrically coupled to the first voltage stepping-down module, and configured to reduce the first buck voltage to generate a second buck voltage;

a dual-in-line package (DIP) switch module, electrically coupled to the second voltage stepping-down module, and configured to generate a maximal current indicating signal according to the second bulk voltage;

a control module, electrically coupled to the second voltage stepping-down module, the DIP switch module and the constant current driving module, and configured to generate a pulse-width modulation (PWM) signal based on the second buck voltage and the maximal current indicating signal; and a loading module, electrically coupled to the control module and the constant current driving module;

wherein the constant current driving module is configured to generate a drive current according to the first buck voltage and the PWM signal, and configured to drive the loading module using the drive current.

2. The LED driving circuit of claim 1, wherein the first voltage stepping-down module comprises:

a voltage stepping-down chip, having an input terminal electrically coupled to the power source, having an output terminal electrically coupled to the constant current driving module, and having a ground terminal coupled to ground.

3. The LED driving circuit of claim 1, wherein the constant current driving module comprises:

a driving chip, having an input terminal electrically coupled to the first voltage stepping-down module for receiving the first buck voltage, and having a control terminal electrically coupled to the control module for receiving the PWM signal; and a switch, having a control terminal electrically coupled to a drive terminal of the driving chip, having an input terminal electrically coupled to ground and an output terminal of the driving chip, electrically coupled to the loading module.

4. The LED driving circuit of claim 3, wherein the constant current driving module further comprising:

a resistor, having a first terminal electrically coupled to the input terminal of the switch and the output terminal of the driving chip, and having a second terminal electrically coupled to ground.

5. The LED driving circuit of claim 3, wherein the switch comprises a metal-oxide semiconductor field effect transistor (MOSFET), the control terminal of the switch comprises a gate of the MOSFET, the input terminal of the switch comprises a drain of the MOSFET, and the output terminal of the switch comprises a source of the MOSFET.

6. The LED driving circuit of claim 3, wherein the switch comprises a bipolar junction transistor (BJT), the control terminal of the switch comprises a base of the BJT, the input terminal of the switch comprises a collector of the BJT, and the output terminal of the switch comprises an emitter of the BJT.

7. The LED driving circuit of claim 1, wherein the second voltage stepping-down module comprises:

a voltage stepping-down chip, having an input terminal electrically coupled to the first voltage stepping-down module for receiving the first buck voltage, having an output terminal electrically coupled to the DIP switch module for relaying the second buck voltage, and having a ground terminal electrically coupled to ground.

8. The LED driving circuit of claim 1, wherein the DIP switch module comprises:

a first resistor, having a first terminal electrically coupled to the second voltage stepping-down module for receiving the second buck voltage;

at least one DIP switch, each of which having an input terminal electrically coupled to a second terminal of the first resistor and the control module; and at least one second resistor having a one-by-one correspondence with the at least one DIP switch;

wherein each of the at least one second resistor has a first terminal electrically coupled to an output terminal of a corresponding DIP switch, and has a second terminal electrically coupled to ground.

9. The LED driving circuit of claim 8, wherein resistances of the at least one second resistor are entirely different.

10. The LED driving circuit of claim 8, wherein resistances of the at least one second resistor are partially different.

11. The LED driving circuit of claim 8, wherein the at least one second resistor shares a same resistance.

12. The LED driving circuit of claim 1, wherein the control module comprises:

a master control chip, having an input terminal electrically coupled to the second voltage stepping-down module for receiving the second buck voltage, having a receiving terminal for receiving the maximal current indicating signal, having a control terminal electrically coupled to the constant current driving module for relaying the PWM signal, and having a ground terminal electrically coupled to ground.

13. The LED driving circuit of claim 1, further comprising:

a voltage transformer, electrically coupled to the first voltage stepping-down module, the constant current driving module, and the loading module.

14. The LED driving circuit of claim 13, wherein the voltage transformer comprises:

a primary winding, having a first terminal electrically coupled to the first voltage stepping-down module, and having a second terminal electrically coupled to the constant current driving module; and a secondary winding, electrically coupled to the loading module.

15. The LED driving circuit of claim 1, wherein the source voltage is a direct-current (DC) voltage.

16. The LED driving circuit of claim 15, wherein the DC voltage is generated by rectifying an alternative-current (AC) voltage.

17. The LED driving circuit of claim 1, wherein the source voltage is an alternative-current (AC) voltage.

18. The LED driving circuit of claim 1, wherein the loading module comprises:

a LED unit.

19. The LED driving circuit of claim 18, wherein the loading module further comprises:

a diode, having a positive terminal electrically coupled to the constant current driving module; and a common mode inductor, having a first input terminal electrically coupled to a negative terminal of the diode, having a second input terminal electrically coupled to ground, and having a first output terminal and second output terminal both electrically coupled to the LED unit.

20. The LED driving circuit of claim 19, wherein the loading module further comprises:

a capacitor, having a first terminal electrically coupled to the first input terminal of the common mode inductor, and having a second terminal electrically coupled to ground.

* * * * *